United States Patent [19]

Schilger

[11] Patent Number: 4,905,440

[45] Date of Patent: Mar. 6, 1990

[54] COMPOSITE COLUMN OR BEAM FOR BUILDING CONSTRUCTION

[76] Inventor: Herbert K. Schilger, 32 Castleglen Ct., N.E., Calgary, Alberta, Canada, T3J 2B8

[21] Appl. No.: 297,348

[22] Filed: Jan. 17, 1989

[30] Foreign Application Priority Data

Jan. 14, 1988 [CA] Canada ..... 556491

[51] Int. Cl.[4] ..... E04B 2/00

[52] U.S. Cl. ..... 52/368; 52/414; 52/601; 52/724; 52/725

[58] Field of Search ..... 52/368, 720, 721, 723, 52/724, 725, 730, 731, 732, 319, 414, 601

[56] References Cited

U.S. PATENT DOCUMENTS

| | | | |
|---|---|---|---|
| 1,658,154 | 2/1928 | Armbruster | 52/725 X |
| 2,073,001 | 3/1937 | Coddington | 52/724 X |
| 2,198,985 | 4/1940 | Bailey | 52/725 X |
| 2,218,705 | 10/1940 | Faber | 52/725 X |
| 3,603,052 | 9/1971 | Novoa | 52/725 X |
| 4,166,347 | 9/1979 | Pohlman et al. | 52/725 X |
| 4,261,156 | 4/1981 | Fromont et al. | 52/724 |

*Primary Examiner*—Richard E. Chilcot, Jr.

[57] ABSTRACT

A composite metal-concrete column or beam is described for use in building construction. It comprises (a) a pair of channel members fabricated of galvanized steel sheet, each channel member having a central web portion and first and second flanges substantially perpendicular to the web portion, the free edges of the flanges forming narrow lips substantially perpendicular to the flanges and the web portion having openings through which wet concrete may freely pass, the channel members being positioned in back-to-back spaced relationship with the flanges projecting outwardly, (b) panel members extending across between the flanges of each the channel member and held within the narrow lips and (c) concrete filling the space between the panel members and extending through and around the web portions, whereby the cured concrete and channel members form a strong, composite structure. The column can be used for a load bearing wall in building construction while the beam can be used in any location where a beam is required in building construction.

5 Claims, 2 Drawing Sheets

COMPOSITE COLUMN OR BEAM FOR BUILDING CONSTRUCTION

This invention relates to building construction and, more particularly to a composite metal-concrete column or beam for use in such construction.

It is commonplace in building construction to provide the load-bearing strength in the walls either by a metal framework or by reinforced concrete. Likewise, for support of floors, roofs, etc. steel beams may be used or reinforced concrete. It is the object of the present invention to provide a simple composite metal-concrete column or beam which will be simpler and less expensive to construct than either steel construction or reinforced concrete construction.

Thus, the invention in its broadest aspect relates to a composite metal-concrete column or beam for use in building construction. It includes a pair of channel members fabricated of galvanized sheet steel, each channel member having a central web portion and first and second flanges substantially perpendicular to the web portion, with the free edges of the flanges forming narrow lips substantially perpendicular to the flanges and the web portion having openings through which wet concrete may freely pass. The channel members are positioned in back-to-back spaced relationship with the flanges projecting outwardly. Panel members extend across between the flanges of each channel member and are held within the narrow lips of each channel member. Concrete fills the space between the panel members and extends through and around the web portions, whereby the cured concrete and channel members form a strong, composite structure.

According to a preferred embodiment, the column has at least one additional open-web channel member mounted parallel to and spaced between the pair of back-to-back channel members. The additional channel member has the web portion thereof embedded in the concrete and serves to further strengthen the column. The channel members are preferably made of 10–20 gauge galvanized steel.

According to another preferred embodiment, when the composite structure is in the form of a beam, an additional open-web channel member is utilized with the back of the web thereof abutting flanges of the pair of back-to-back channel members. A panel member extends across between the flanges of the additional channel member and is held within the lips thereof. Concrete extends through and around the webs of the three channel members and fills the space between the panel members of these channel members. The additional channel member is placed along the bottom of the beam and provides a very strong composite structure.

The column members may serve as support columns of a load bearing wall of a building. For this purpose, the composite columns are laterally spaced and a plurality of metal stud members are positioned between each spaced pair of columns. Panel members can then be mounted on the columns and studs to finish the wall. The beam embodiment of the invention may be supported by the columns. The beams may then be used to support a floor or a ceiling structure. For a multiple storey construction, further columns etc. may be placed above the floor and the entire construction sequence repeated for each floor. The floor structure may be as shown Schilger in U.S. Pat. No. 4,602,467.

The beam of this invention may also be used in home construction and can replace the traditional steel I-beam.

Thus, the open-web channel members and permanent formwork panels can be assembled in place without heavy equipment. Then it is simply a matter of pouring in concrete from the top and allowing it to cure.

Certain preferred embodiments of the invention are illustrated by the accompanying drawings wherein.

Figure 1:
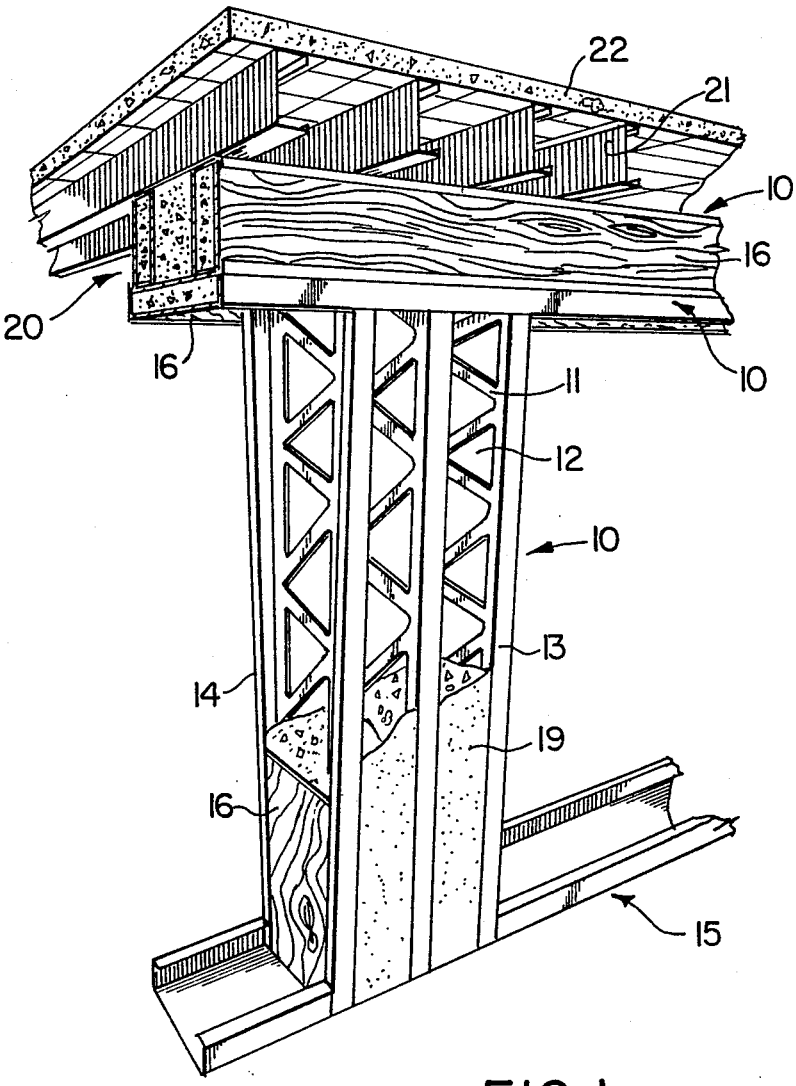
FIG. 1 is a perspective view of a column and beam according to the invention.

A column as shown in FIG. 1 includes three open-web channel members 10, each channel member having a web portion 11 with large holes 12 therein. Each channel member also includes a flange portion 13 substantially perpendicular to the web and a narrow lip portion 14 which is substantially perpendicular to the flange.

Figure 2:
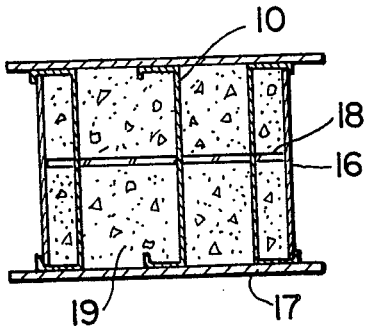
FIG. 2 is a sectional view of a column under construction.
Figure 3:
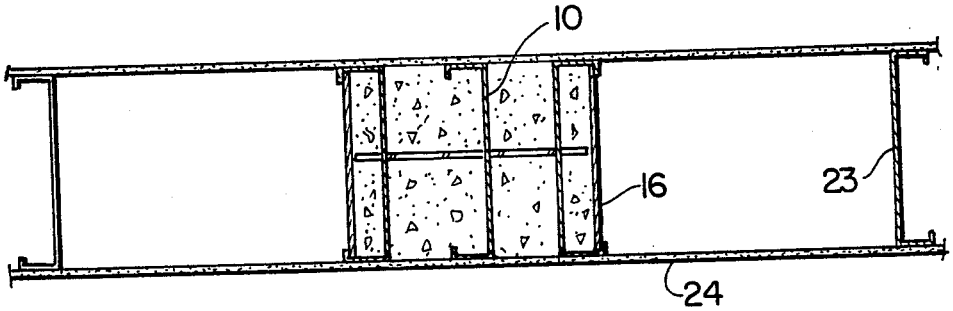
FIG. 3 is a sectional view of a load-bearing wall.

The three channel members 10 are arranged in spaced relationship as shown in FIG. 1 with the flanges turned outwardly as can be seen from FIG. 2. The bottom ends of the channel members 10 rest on a bottom channel member 15.

Panels 16 are permanently positioned extending across between the flanges 13 and inside the lips 14. The space between the panels is entirely filled with concrete 19 which extends through the web holes of all three channels, firmly locking the channels thereto.

In order to construct the column, the open-web channel members are positioned as described above and formwork panels 17 are mounted along the edges of the channels abutting against the flanges 13 in the manner shown in FIG. 2. Reinforcing bars 18 may extend across through the holes of the webs. With all of the channels and panel members firmly held together, concrete is poured in from one end and is allowed to entirely fill the spaces such that the web portions are firmly locked to the concrete. When the formwork panels 17 are removed, a column appearing as shown in FIG. 1 is formed.

Figure 4:
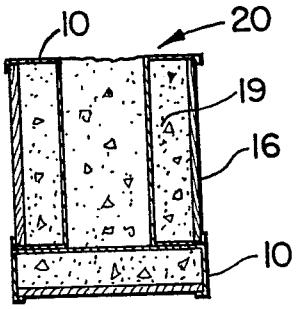
FIG. 4 is a sectional view of a beam according to the invention.

In order to build a beam 20, open-web channel members 10 are placed back-to-back as shown in FIGS. 1 and 4 and a third open-web channel member is placed beneath the pair of back-to-back channel members with the web thereof abutting the flanges of the pair of back-to-back channel members. Panel members are permanently inserted into the flanges of all three channel members behind the lips thereof. With these panels all in place and the three channel members being held firmly together, wet concrete is poured in from the top whereby it passes through the openings 12 to entirely fill the space between the panels 16. When this composite structure has cured, a very strong reinforced beam is formed.

A floor structure is formed by positioning channel members 21 with formwork and pouring a reinforced concrete slab 22 by well known techniques.

The foregoing is considered illustrative only of the principles of the invention. Numerous modifications will readily occur to those skilled in the art and, for instance, it will be readily evident that the holes in the channel member web may assume an infinite variety of shapes provided they permit easy movement of wet concrete through and around the web. Accordingly, all suitable modifications and equivalents may be resorted to as may fall within the scope of the appended claims.

It is claimed:

1. A composite metal-concrete column or beam for use in building construction comprising:

(a) a pair of channel members fabricated of galvanized steel sheet, each channel member having a central web portion and first and second flanges substantially perpendicular to said web portion, said flanges having free edges providing narrow lips substantially perpendicular to the flanges and the web portion having openings through which wet concrete may freely pass, said channel members being positioned in back-to-back spaced relationship with said flanges projecting outwardly, (b) panel members extending between the flanges of each said channel member and held within said narrow lips and (c) concrete filling the space between said panel members and extending through and around said web portions, whereby the cured concrete and channel members form a strong, composite structure.

2. An article according to claim 1 comprising at least one additional open-web channel member mounted parallel to and spaced between said pair of back-to-back channel members.

3. An article according to claim 1 comprising an additional open-web channel member with the channel member web having a back portion abutting flanges of said pair of back-to-back channel members, a panel member extending between flanges of said additional channel member and held within lips formed at free edges of said flanges, with concrete extending through and around the webs and filling the space between the panel member of the additional channel member and the panel members of said pair of back-to-back channel members.

4. A load-bearing wall for a building comprising a plurality of spaced support columns as claimed in claim 2, a plurality of metal stud members positioned between each spaced pair of columns and panel members mounted on the columns and stud members to finish the wall.

5. A method of making a column comprising:

(a) a pair of channel members fabricated of galvanized steel sheet, each channel member having a central web portion and first and second flanges substantially perpendicular to said web portion, said flanges having free edges providing narrow lips substantially perpendicular to the flanges and the web portion having openings through which wet concrete may freely pass, said channel members being positioned in back-to-back spaced relationship with said flanges projecting outwardly and at least one additional open-web channel member mounted parallel to and spaced between said pair of back-to-back channel members, (b) panel members extending between the flanges of each said channel member and held within said narrow lips and (c) concrete filling the space between said panel members and extending through and around said web portions which comprises positioning said pair of channel members in back-to-back spaced relationship, placing said panel members within said flange lips, mounting movable formwork panels between said pair of spaced channel members on the outside of the flanges thereof, pouring wet concrete into the space between the panels such that it passes through and surrounds the webs, allowing the concrete to cure and removing the formwork panels from the outside of the flanges, thereby forming a strong, composite structure.

* * * * *